United States Patent [19]

Goggin

[11] Patent Number: 4,877,084

[45] Date of Patent: Oct. 31, 1989

[54] GAS WELL DISCHARGE VELOCITY DISSIPATOR

[76] Inventor: Philip E. Goggin, P.O. Box 4186, Marbleton, Wyo. 83113

[21] Appl. No.: 270,839

[22] Filed: Nov. 14, 1988

[51] Int. Cl.[4] ..... B05B 1/26; B05B 1/20

[52] U.S. Cl. ..... 166/75.1; 181/267; 239/523; 239/462

[58] Field of Search ..... 166/75.1, 369; 239/271, 239/288, 461, 462, 288.3, 288.5, 499, 523, 754; 169/69; 181/227, 239, 267; 405/43

[56] References Cited

U.S. PATENT DOCUMENTS

| | | | |
|---|---|---|---|
| 1,110,512 | 9/1914 | Rodwick | 181/239 |
| 1,957,119 | 5/1934 | Ware | 166/75.1 |
| 2,665,760 | 1/1954 | Hulsey | 166/75.1 |
| 3,554,290 | 1/1971 | Verdin | 166/75.1 X |
| 3,635,309 | 1/1972 | Nemcansky et al. | 181/267 |
| 4,224,985 | 9/1980 | Rapson | 166/75.1 X |
| 4,241,805 | 12/1980 | Chance, Jr. | 181/267 X |
| 4,530,418 | 7/1985 | Currie | 181/227 |

*Primary Examiner*—Stephen J. Novosad
*Attorney, Agent, or Firm*—Charles C. Corbin

[57] ABSTRACT

Provided is a device for dissipating, safely and in an environmentally sound manner, a high pressure fluid discharge from a gas well. The device is locatable in an earthen pit and connectable to the end of a discharge conduit. There is an open-bottomed hood having a front wall, a rear wall and curved side and upper wall, with the well discharge conduit connecting through the front wall. Mounted within the hood is a first dissipator tube having a perforated wall and a significantly larger diameter than the discharge conduit, and including a front end connected to the discharge conduit. A deflector plate, having a multitude of perforations, is mounted across this first tube near its open rear end. A second, open-ended dissipator tube has a larger diameter than the first dissipator tube, and an array of apertures in its lower wall. It is mounted co-axially with the first dissipator tube with its front end adjacent the rear end of the first tube, and its rear end adjacent to and spaced from the rear wall of the hood. The second dissipator tube also mounts a perforated deflector plate near its rear portion, along with a vertically extending member for deflecting a stream it intercepts into two diverging portions.

12 Claims, 2 Drawing Sheets

GAS WELL DISCHARGE VELOCITY DISSIPATOR

BACKGROUND OF THE INVENTION

1. Field of the Invention

The invention relates generally to devices for controlling the discharge of a high pressure gaseous stream, and more particularly to a device for suppressing and dissipating a high pressure, high velocity discharge from a gas well.

2. Description of the Prior Art

Gas wells in production occasionally will suffer an interruption of gas flow when it becomes "loaded off" with liquid, which can occur when there is not enough gas pressure and velocity in the production line to carry along the liquid to the liquid/gas separator unit of the production line. In order to correct this problem the conventional practice is to "blow off" the well by using a discharge line going directly from the well head to an earthen pit, and releasing the well contents directly to atmospheric pressure. By virtue of the high velocity of the escaping gas, the plugging liquids will be carried along and discharged with the gas.

There are many drawbacks associated with blowing off a gas well in the conventional manner, including safety hazards to people and animals, the danger of fire, environmental pollution, and the waste of a significant quantity of petroleum liquids. The release of the stream of liquid and gas will impact the side of the pit with considerable force and velocity resulting in the scattering of petroleum liquids and entrained debris into the surrounding environment. The scattered oil will pollute the immediate area and also represents an appreciable waste of petroleum product. There also often results a gouging and undercutting of the sides of the pit which can enlarge it beyond the confines of a safety fence, thereby exposing people and animals to the danger of falling into the pit. When rocks and debris are sent flying, there is an obvious danger to people in the vicinity, including a danger from flash fire when columns of natural gas are ignited by sparking caused by colliding rocks.

One approach to the problem of oil contamination, which is used particularly when the blow off stream carries a high percentage of oil, is to intentionally ignite it to flare it off. This, however, is a risky procedure and wasteful.

SUMMARY OF THE INVENTION

In view of the foregoing it is a general object of the present invention to provide a means for releasing a high pressure stream of gas and liquid from a well to atmospheric pressure in a manner that is environmentally safe and nonhazardous.

Another object is to provide means, mountable in a recovery pit, which dissipates a high velocity stream of gas and liquids and which allows the liquid component to be recovered.

A further object is to provide a gas well blow-down suppressor and dissipator having a relatively compact construction which lends itself to mounting in a containing pit or the like.

A still further object is to provide a device connectable to a gas well blow-down line to prevent the spraying of petroleum liquids into the environment.

The foregoing and still further objects and advantages are achievable by the present invention which is a velocity suppression and stream dissipation device mountable in an earthen or other recovery pit and connectable to the terminus of a conduit leading from a well. The invention includes an open-bottomed semicylindrically shaped hood, having a front wall, rear wall and curved mid wall, with means at the front wall for connection with the conduit so as to direct a fluid stream into the hood in the direction of the rear wall of the hood. Mounted within the confines of the hood is a first dissipator tube that lies with its axis generally perpendicular to the rear wall and having its front end connected to the front wall conduit connection means. This first dissipator tube has a plurality of apertures in its tubular wall, and a grate having a multitude of fluid conducting and deflecting apertures is affixed within this first tube near its open rear end. The invention also features a second dissipator tube having a significantly larger diameter than the first tube and aligned co-axially therewith, and having a plurality of apertures in its wall. Its open front end lies adjacent the rear of the first tube and its rear end is spaced adjacent to and apart from the rear wall of the hood. Disposed across the rearward portion of the second tube is a second grate, also having a multitude of stream passing and deflecting apertures therein. Adjacent this second grate is a vertically extending blade adapted to deflect an impinging stream into two diverging portions.

DETAILED DESCRIPTION OF THE INVENTION

Figure 1:
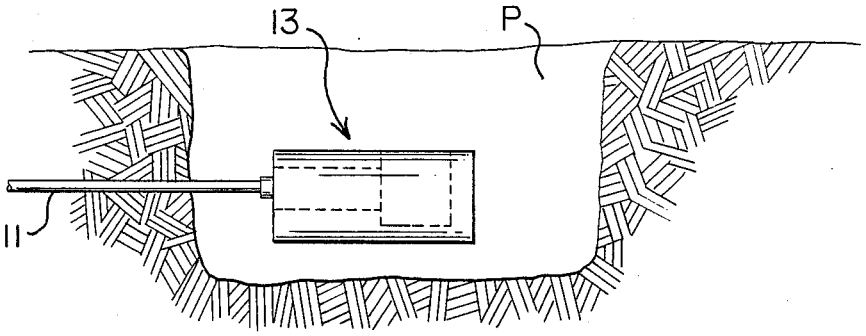
FIG. 1 is a side elevation showing a blow-down dissipator according to the present invention, mounted to the end of a gas well discharge line and located in a recovery pit.
Figure 2:
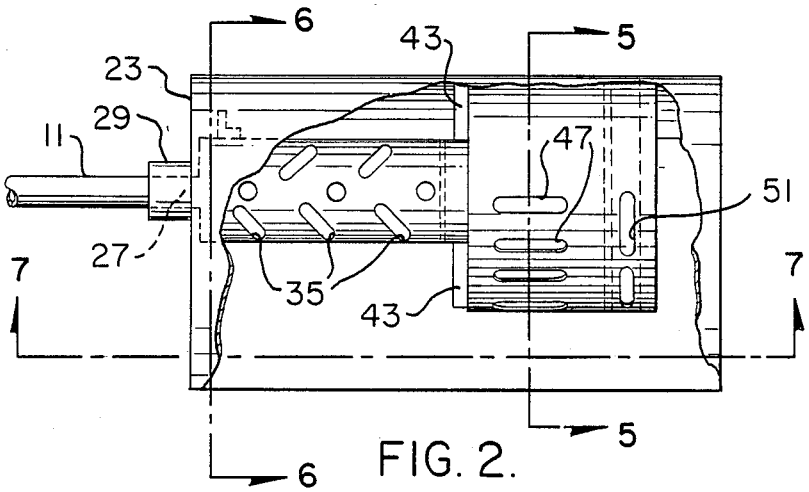
FIG. 2 is a side elevational view of the device of the invention with parts of the hood wall broken away for the sake of clarity.
Figure 3:
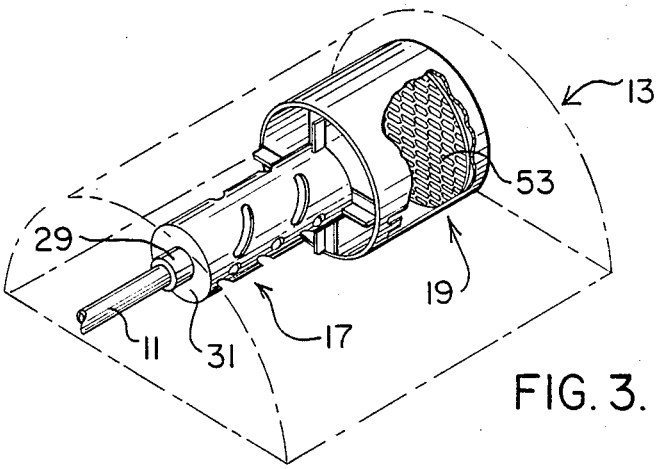
FIG. 3 is a view in perspective with the hood of the inventive device shown in phantom.

Referring now to the drawings, FIG. 1 illustrates a blow-down conduit 11 which extends from a conventional valve-controlled connection with the well head of a nearby gas well (not shown) to a blow-down suppressor and dissipator 13 constructed according to the invention and disposed within an earthen recovery pit P. The main components of the invention are shown in FIGS. 2 and 3 to comprise a hood 15, and mounted within hood 15, a first dissipator tube 17 and a second dissipator tube 19. These and other components, to be described, are fabricated using cutting and welding techniques well known in the metal fabrication industry.

The hood 15 has downwardy curved wall portion 21 which is fabricated from a section of steel pipe stock which has been cut in half along diametrically opposite lines parallel to the axis of the pipe section. This technique lends itself to efficient fabrication of two curved walls per pipe section. Hood 15 is completed by the attachment to wall 21 by welding, semi-circular end plates to form front wall 23 and rear wall 25. In the preferred embodiment the inner surface of hood 15 is painted or otherwise coated to provide a smooth surface so as to deter the sticking of the heavier petroleum substances such as parafins, and to enhance run off of liquids, for reasons which will become apparent upon further reading of this specification. A short conduit 27 with threaded front end is affixed through a central portion of front wall 23, and a high pressure coupling 29 of conventional design, such as a hammer union, secures the conduit 27 to the blow-down conduit 11 which is held perpendicularly to front wall 23. Thus the inventive unit 13 is supported at a generally horizontal position within the pit P.

Figure 4:
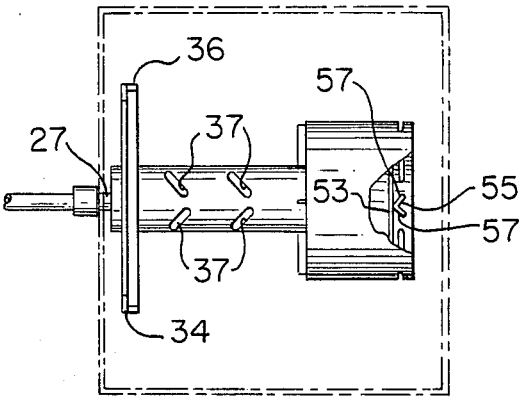
FIG. 4 is a top view of the device shown in FIG. 2, with parts broken away and shown in phantom for the sake of clarity.
Figure 5:
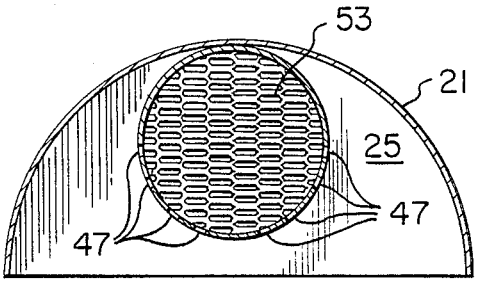
FIG. 5 is a sectional view taken along a plane through the line 5—5 of FIG. 2.

The first dissipator tube 17 extends into hood 15 in a direction parallel to the cylindrical axis of the hood and is perpendicular to walls 23 and 25, and has a rear wall 31 that lies concentrically around short conduit 27. The forward end of first dissipator tube 17 is affixed to a brace 32 having ends 34 and 36 that are welded to hood wall 21. FIGS. 2 and 5 show that the lower half of the wall of first tube 17 has cut therein an array of slanted apertures 35. FIG. 4 shows that the upper portion of tube 17 is provided with a smaller number of apertures 37. Opposite sides of tube 17 have an array of circular vents 39, shown in FIGS. 2 and 3.

As illustrated in FIG. 2, a grate 41 is affixed by welding within tube 17 near its open end 33. This grate 41 is fabricated of what is known in the metal industry as expanded metal grating. Such grating is characterized by a multitude of perforations and the grate 41 is preferably aligned so that its perforations are elongated in a horizontal direction. It is also noted that in such expanded metal material, the metal structure peripheral to each of its perforations is a vane-like structure with a contour which will tend to divert a fluid stream passing through the perforations. The grate 41 aligned to divert a stream in an upward direction.

Figure 7:
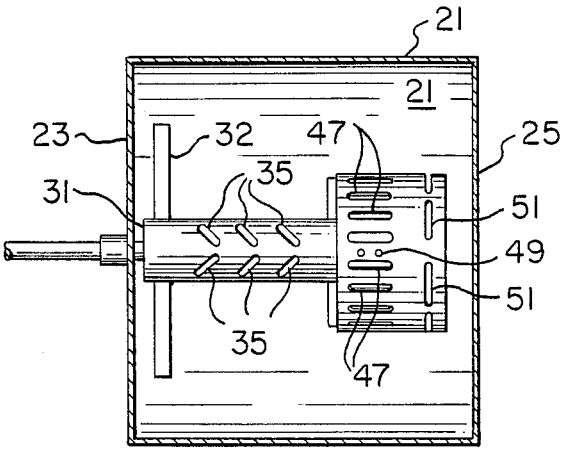
FIG. 7 is a bottom, sectional view taken along a plane through the line 7—7 of FIG. 2.
Figure 6:
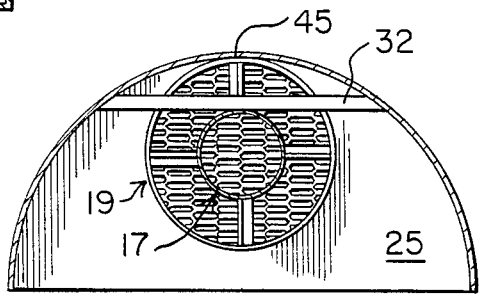
FIG. 6 is a sectional view taken along a plane through the line 6—6 of FIG. 2.

The second dissipator tube 19 is open ended and has a diameter, in the preferred embodiment, about twice as large as first tube 17 and is aligned co-axially therewith. Angle iron braces 43 are welded to hold the back, or discharge end of tube 17 in centered relationship with the open front end of the second tube 19, and the rear end of tube 19 is spaced from the hood rear wall 21 as illustrated in FIG. 4 and 7. As illustrated in FIG. 6 the second dissipator tube 19 is secured to the uppermost part of the ceiling of hood wall 21, by welding at contact location 45 and a corresponding location (not shown) at the opposite end of tube 19. FIG. 7 shows that the lower half of tube 19 has an array of sloped apertures 47 and holes 49, lying around the forward portion of tube 19. The lower half of tube 19 also has elongated apertures 51, in its rear portion and lying perpendicularly to apertures 47. The upper half of tube 19 has no openings.

There is a second grate 53, mounted in tube 19 near its rear end. Grate 53 has a construction similar to that of first grate 41, however its structure is oriented so as to tend to divert a fluid stream downwardly. FIGS. 4 and 5 show that just behind grate 53 lies a vertically extending diverter member 55 which is welded to the inside of tube 19. Member 55 may comprise a section of angle iron which is aligned so that its stream diverting surfaces 57 are about 45 degrees to the axis of tube 19. Aligned thusly the member 55 will tend to direct an impinging fluid stream into diverging paths. It is noted that member 55 abuts the grate 53 to lend it additional support.

It is noted that the tubular components of the invention have increasingly larger diameters. By way of example, but not in a limiting fashion, the short inlet conduit 27 may have a diameter of 3 inches, the first and second dissipator tubes 17 and 19 diameters of 10 and 20 inches respectively, and the curved wall of hood 15 an effective diameter of 40 inches.

As FIG. 1 shows the device 13 is mounted somewhat centrally within the pit P with the bottom opening of hood 15 facing and spaced apart from the floor of the pit. When it is necessary to blow down the gas well to which line 11 is connected, the valve controlling line 11 is opened to pass a high pressure stream of natural gas and entrained liquids, which liquids typically include petroleum liquids and water, (and sometimes ice chunks). The high pressure, high velocity stream will be released to atmospheric pressure within device 13, into which it discharges at the front end of first dissipator tube 17, in the direction of the axis of tube 17. The stream will experience an initial velocity reduction in its passage through tube 17 and the grate 41 will break up any ice pieces carried in the stream, and will exert a certain back pressure allowing some outflow of gas and liquid through apertures 35 and 37. The stream velocity is further significantly reduced as it discharges into the larger, second dissipator tube 19, and the liquid components will tend to collect on the interior structure of tube 19 and fall out via the apertures 47, 49 and 51. The second grate 53 will tend to dispose the stream and collect liquid. As the de-energized stream is further diverted by the action of member 55 it will wash against the rear hood wall 25 with minimal velocity.

Hood 51 will contain the dissipated stream contents and direct them downwadly, and the liquid which collects on its inner surface will run off and into the pit P. The dissipated natural gas will escape at a velocity that is too low to cause any scattering of the accumulating pit contents. Thus the use of the invention makes possible the recovery of petroleum liquids when the contents of the pit P are pumped to a conventional water separation unit.

While the invention has been particularly shown, described and illustrated in detail with reference to a preferred embodiment, it is should be understood by those skilled in the art that the foregoing is exemplary only, and that equivalent changes in form and detail may be made therein without departing from the true spirit and scope of the invention as claimed.

What is claimed is:

1. Device for dissipating a high pressure stream of gas and liquid conducted for a well through a discharge line for release to atmospheric pressure, said device mounted at the end of said line and locatable in a liquid containment enclosure, said device comprising:

(a) open-bottomed hood mountable in said enclosure with the hood bottom spaced from the bottom of said enclosure and said hood having a front wall, an opposing rear wall and a downwardly sloped mid wall;

(b) conduit means mounted through said front wall and connected to said discharge line for discharging said stream towards the rear wall of said hood;

(c) first dissipator tube lying with its axis generally perpendicular to the rear wall of said hood and having a front wall connected to said conduit for conducting said stream into said first tube, the tubular wall of said first tube having a plurality of apertures therein and the diameter of said first tube being larger than the diameter of said conduit;

(d) first grate affixed within the rearward portion of said first tube and having a multitude of stream-passing apertures therein, (e) second dissipator tube having a diameter significantly larger than the diameter of said first tube and mounted coaxially with said first tube with the open rear end of said first tube disposed at the open front end of said second tube, and the open rear end of said second tube spaced from and directly opposite the rear wall of said hood, and the wall of said second tube having a plurality of apertures therein; and (f) second grate affixed within the rearward portion of said second tube, and having a multitude of stream-passing apertures therein.

2. Device as defined in claim 1 including a generally vertically extending deflector means mounted across the rearward portion of said second tube, and for intercepting said stream and tending to separate said stream into diverging components.

3. Device as defined in claim 1 wherein said hood has a semi-cylindrical shape.

4. Device as defined in claim 1 wherein the inner surfaces of said hood are coated for smoothness.

5. Device as defined in claim 1 wherein said first and second grates lie perpendicularly to the axes of said first and second tubes.

6. Device as defined in claim 1 wherein the wall of said first tube has significantly more apertures in its lower half than in its upper half.

7. Device as defined in claim 6 wherein the apertures in the wall of said second tube lie in the lower half of said wall.

8. Device as defined in claim 1 wherein each of the apertures in said first grate and said second grate is elongated in a generally horizontal direction.

9. Device as defined in claim 8 wherein said first grate has a construction which will tend to deflect said stream upwardly and said second grate has a construction tending to deflect said stream downwardly.

10. Device as defined in claim 1 wherein said first and second grates are formed of expanded metal grating material.

11. Device as defined in claim 1 wherein the diameter of said second tube is about twice the diameter of said first tube, and the effective diameter of said hood is about twice the diameter of said second tube.

12. Device as defined in claim 2 wherein said deflector means is mounted just behind said second grate.

* * * * *